US011647826B2

(12) United States Patent
Ressler

(10) Patent No.: US 11,647,826 B2
(45) Date of Patent: May 16, 2023

(54) HAMMOCK

(71) Applicant: Dutch Clips LLC, Lancaster, PA (US)

(72) Inventor: Thomas Ressler, Reinholds, PA (US)

(73) Assignee: Dutch Clips LLC, Lancaster, PA (US)

( * ) Notice: Subject to any disclaimer, the term of this patent is extended or adjusted under 35 U.S.C. 154(b) by 13 days.

(21) Appl. No.: 17/313,661

(22) Filed: May 6, 2021

(65) Prior Publication Data

US 2022/0354241 A1 Nov. 10, 2022

(51) Int. Cl.
*A45F 3/22* (2006.01)
*A45F 3/24* (2006.01)

(52) U.S. Cl.
CPC . *A45F 3/22* (2013.01); *A45F 3/24* (2013.01)

(58) Field of Classification Search
CPC ..... A45F 3/22; A45F 3/24
USPC ..... 5/120–123, 127, 128, 130
See application file for complete search history.

(56) References Cited

U.S. PATENT DOCUMENTS 495,366 A * 4/1893 Perry ..... A45F 3/22 5/121
1,094,412 A * 4/1914 Ashworth ..... A45F 3/22 5/121
1,156,200 A * 10/1915 Ashworth et al. ..... A45F 3/22 5/121
1,401,846 A * 12/1921 Wiles ..... A45F 3/22 5/121
2,375,792 A * 5/1945 Kearny ..... A45F 3/22 5/121
4,071,917 A * 2/1978 Mojica ..... E04H 15/04 135/96
4,308,883 A * 1/1982 Malone ..... E04H 15/32 135/90
6,347,638 B1 * 2/2002 Scott et al. ..... E04H 15/04 135/96
6,711,763 B2 * 3/2004 Batchelder et al. ..... A45F 3/22 5/120
10,897,982 B2 * 1/2021 Ressler ..... A45C 13/103
11,412,836 B2 * 8/2022 Ressler ..... A45C 13/103
2017/0202344 A1 * 7/2017 Ressler ..... A45F 3/22
2021/0106128 A1 * 4/2021 Ressler ..... A45F 3/24
2022/0346533 A1 * 11/2022 Ressler ..... A45C 13/103
2022/0354241 A1 * 11/2022 Ressler ..... A45F 3/22

* cited by examiner

*Primary Examiner* — Robert G Santos
(74) *Attorney, Agent, or Firm* — Barley Snyder

(57) ABSTRACT

A hammock assembly is provided and includes, a hammock, a zipper fastening system and a cover and dual cover suspension lines. The hammock may be a bridge hammock using dual spreader bars to maintain the hammock in an expanded configuration. The dual cover suspension lines suspend the cover with a horizontal generally planar portion of the cover between the dual cover suspension lines, thereby providing an expansive canopy.

15 Claims, 7 Drawing Sheets

HAMMOCK

FIELD OF THE INVENTION

The present invention relates to a hammock, and more particularly, to a hammock having a zipper fastener system, a suspended cover, and hammock spreader components.

BACKGROUND

Hammocks are well known and frequently employed for recreational purposes, being suitable for swinging, resting and sleeping. Hammocks typically may be classified by type, depending on whether the hammock provides a spreader bar or not. Those with a spreader bar are often known as bridge hammocks, and those without are often referred to as gathered end hammocks, each having advantages and disadvantages. The bridge hammocks are preferred for providing a flatter lie and wider sleeping area, compared to the spreader-less hammock providing a more curved body position while lying in the hammock, and generally more confining occupant space as the gathered ends may cause the hammock to envelop the occupant, unless additional tethers are employed to maintain the hammock in a more open position.

It is known to provide a zipper fastener system to allow the use of additional components with the hammocks, such as canopy covers, often made of lightweight mesh for prevention of insects.

There is a need for a bridged hammock incorporating a zipper fastener system having connection sections attached to independent pieces of the articles that may be secured to and removed from each other utilizing one or more sliders, and further providing a cover suspension system that creates a spacious canopy over the occupant.

SUMMARY

In view of the foregoing, a hammock assembly is provided in the form of a bridge type hammock providing a spreader bar at each end of the hammock body to open up the width of the hammock body, a suspended cover and a zipper fastening system. The zipper fastening system includes a first tape section and second tape section corresponding to the first tape section. The hammock includes a hammock body with the first tape section attached to an edge thereof. The cover includes a cover body having the second tape section attached to an edge thereof. The cover is removably attachable to the hammock by connecting the first tape section and the second tape section. The cover is suspended by one or more cover suspension lines. Each of the one or more cover suspension lines is configured to pass through the cover at each end through a pair passages, suspending the cover therebetween. The passage openings in the cover may be reinforced and further have a sealing element that is capable of sealing the opening through which the cover suspension lines are passed.

In an exemplary embodiment, there may be provided a hammock assembly having: a hammock having a hammock body and configured to be suspended along a longitudinal axis between first and second supports; a cover having a cover body that is arranged to be suspended above and removably attached to the hammock; a zipper fastening system arranged to reversibly secure the cover to the hammock body; and a cover suspension system having first and second cover suspension lines that suspend a portion of the cover in a generally planar horizontal configuration between the first and second cover suspension lines.

In an exemplary embodiment, the zipper fastening system has a first tape section attached to an edge of the hammock body and a second tape section attached to an edge of the cover body and corresponding to the first tape section, such that the cover is removably attached to the hammock by connecting the first tape section and the second tape section. The first tape section can have a first set of fastener elements extending along its length, a first retainer box positioned at a first end of the first set of fastener elements, and a first slider movably attached to the first tape section and engageable with the first retainer box.

In an exemplary embodiment, the hammock assembly has a first and second spreader bar, each having ends that may be mechanically secured to a first end and second end of the hammock body, respectively, such that the spreader bars can maintain the hammock body in an expanded state in an orientation that is perpendicular to the longitudinal axis.

In an exemplary embodiment, the hammock has a suspension system with a suspension triangle at each of the first and second ends of the hammock body, the suspension triangle at the first end of the hammock body having a first pair of suspension devices that are each mechanically secured at one end to the first spreader bar ends, and at the other end to a first anchor point; the suspension triangle at the second end of the hammock body having a second pair of suspension devices that are mechanically secured at one end to the second spreader bar ends, and at the other end to a second anchor point.

In an exemplary embodiment, the first cover suspension line is extended between one of the suspension devices in the suspension triangle at the first end of the hammock to one of the suspension devices in the suspension triangle at the second end of the hammock, and the second cover suspension line is extended between the other of the suspension devices in the suspension triangle at the first end of the hammock to the other of the suspension devices in the suspension triangle at the second end of the hammock, and the first and second cover suspension lines are extended without crossing. The first cover suspension line and the second cover suspension line support the cover along the length of the cover, to create an enclosable space between the hammock and the cover. The first and second cover suspension lines each pass through the cover body at a respective first passage located at a first end of the cover body, and through the cover body again at a respective second passage located at a second end of the cover body.

In an embodiment, each of the first and second passages are provided with a grommet, through which the respective first or second cover suspension lines pass. In an embodiment, each of the first and second passages have a reinforcement securing the grommet to the cover body. In some embodiments, the first and second passages may have a repositionable seal that seals the opening of the passage after the cover suspension lines have been passed through the passages.

In an exemplary embodiment, the cover body is formed of a first material and a second material. The first material may be a material such as nylon, cotton, silk, polyester, polypropylene, polyethylene, or polytetrafluoroethylene, and the second material may be a netting material. In an embodiment, the second material makes up a sufficient percentage of the cover body to permit adequate ventilation from an enclosed space between the hammock and the cover. In an exemplary embodiment, the cover body is formed of a netting material.

In an exemplary embodiment, the cover may have a location identifier, and the hammock body may have a corresponding location identifier, such that the cover location identifier and hammock body location identifiers when aligned, ensure that the cover is in proper orientation to be suspended over the hammock body.

In an exemplary embodiment, the hammock body has gussets at the corners of the hammock body, the gusset serving to facilitate the actuation of the zipper fastening system at the corner. The gusset may be a flexible material extending in from a perimeter of the hammock body at the corner, and to which the first tape section is attached.

In an exemplary embodiment, the cover of the hammock is suspended such that there is a generally planar horizontal configuration of the suspended cover portion between the cover lines, and having a width dimension that is perpendicular to the longitudinal axis, and the width dimension is at least half the width dimension of the hammock body. Further, the cover has a portion that is not suspended in a generally planar horizontal orientation, and is extended between the first or second cover suspension lines and the long edge of the hammock body at an angle that exceeds 50 degrees from horizontal.

BRIEF DESCRIPTION OF THE DRAWINGS

The invention will now be described by way of example with reference to the accompanying figures of which.

DETAILED DESCRIPTION OF THE EMBODIMENT(S)

Figure 1:
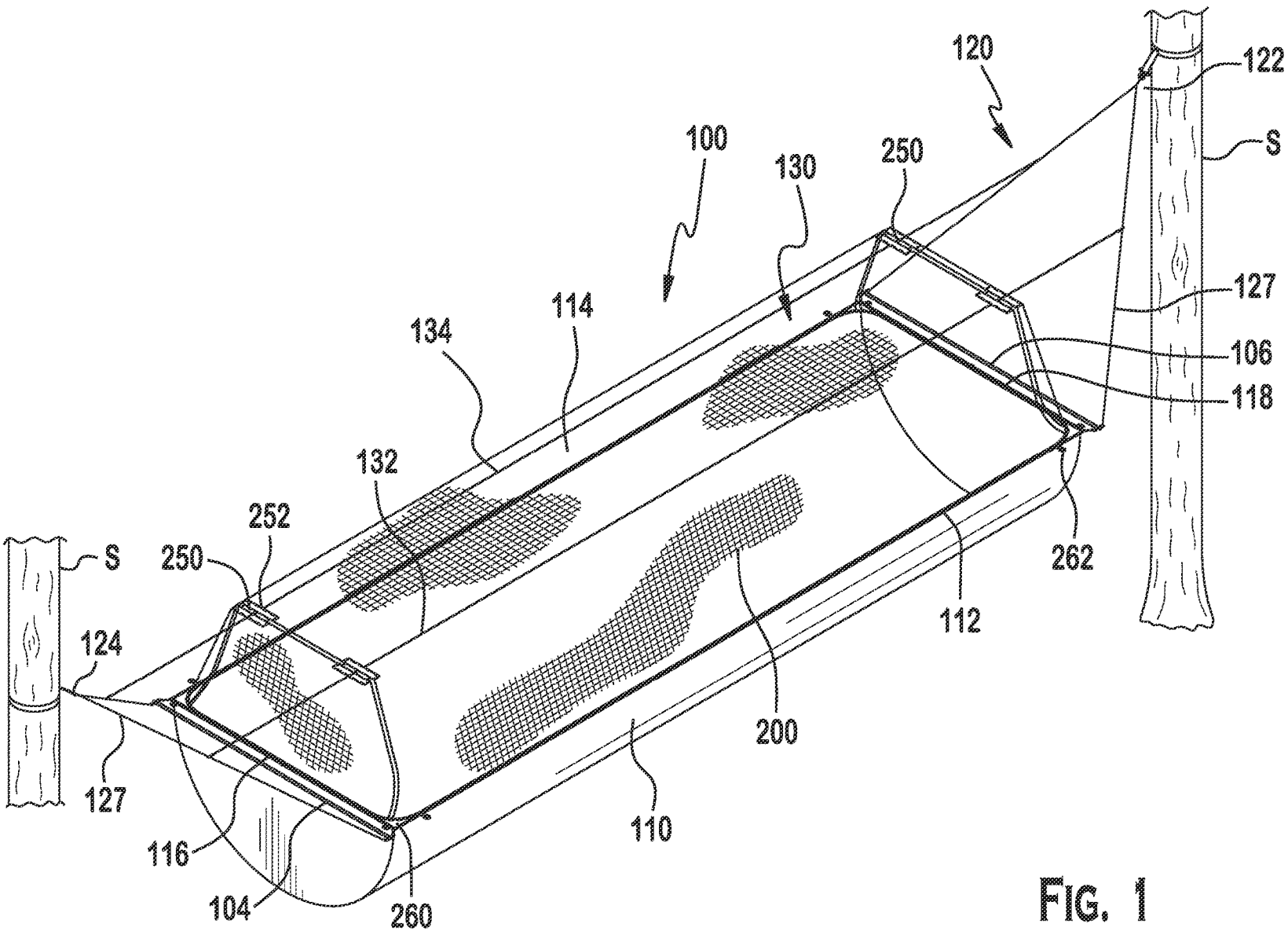
FIG. 1 is a perspective view of a hammock system according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Hammock System

A hammock 100 and cover 200 having a zipper fastener system 1 according to the invention will now be described in greater detail with reference to FIGS. 1-5.

The hammock 100, shown generally in FIGS. 1-5, includes a hammock body 110, a suspension system 120, a pair of spreader bars 104, 106 at each end of the hammock, a detachable cover 200 suspended over the hammock body 110, and a cover suspension system 130.

Hammock Body

Figure 2:
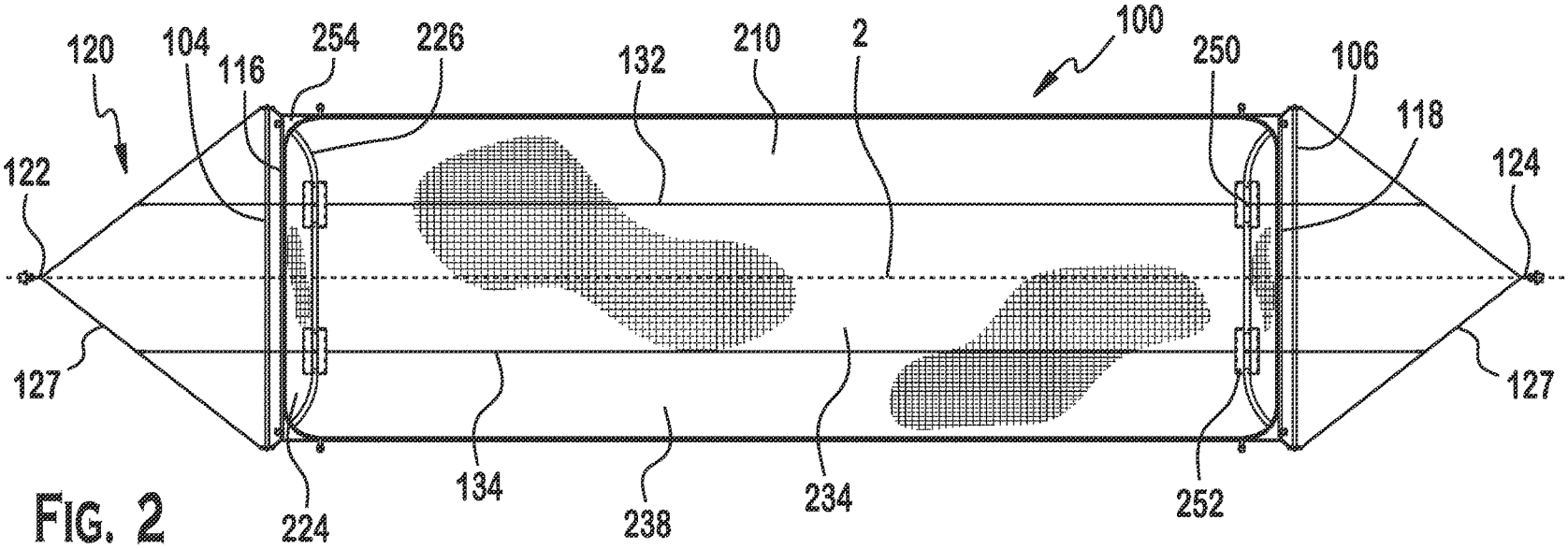
FIG. 2 is a top view of the hammock system of FIG. 1.

The hammock body 110, as shown in FIG. 1, has a first long edge 112, an opposite second long edge 114, a first short edge 116, and an opposite second short edge 118. In the shown embodiment, the hammock body 110 when suspended with the spreader bars 104, 106 (discussed below) in place, presents a generally rectangular shape when viewed from above (as depicted in FIG. 2), and may provide a generally semi-cylindrical shape when suspended, as shown in FIG. 1. It is contemplated that the hammock body 110 may be presented with alternative shapes and dimensions that will be familiar to those of skill in the art and be suitable for use as a bridge hammock; and need not be limited solely to the exemplary semi-cylindrical embodiment depicted in FIG. 1. The hammock body 110 may be formed of any suitable fabric material, including as non-limiting examples, nylon, cotton, silk, polyester, polypropylene, polyethylene, polytetrafluoroethylene, or other lightweight, durable fabrics, and may be reinforced with a ripstop pattern such as a HEXON ripstop grid.

Spreader Bars

Figure 4:
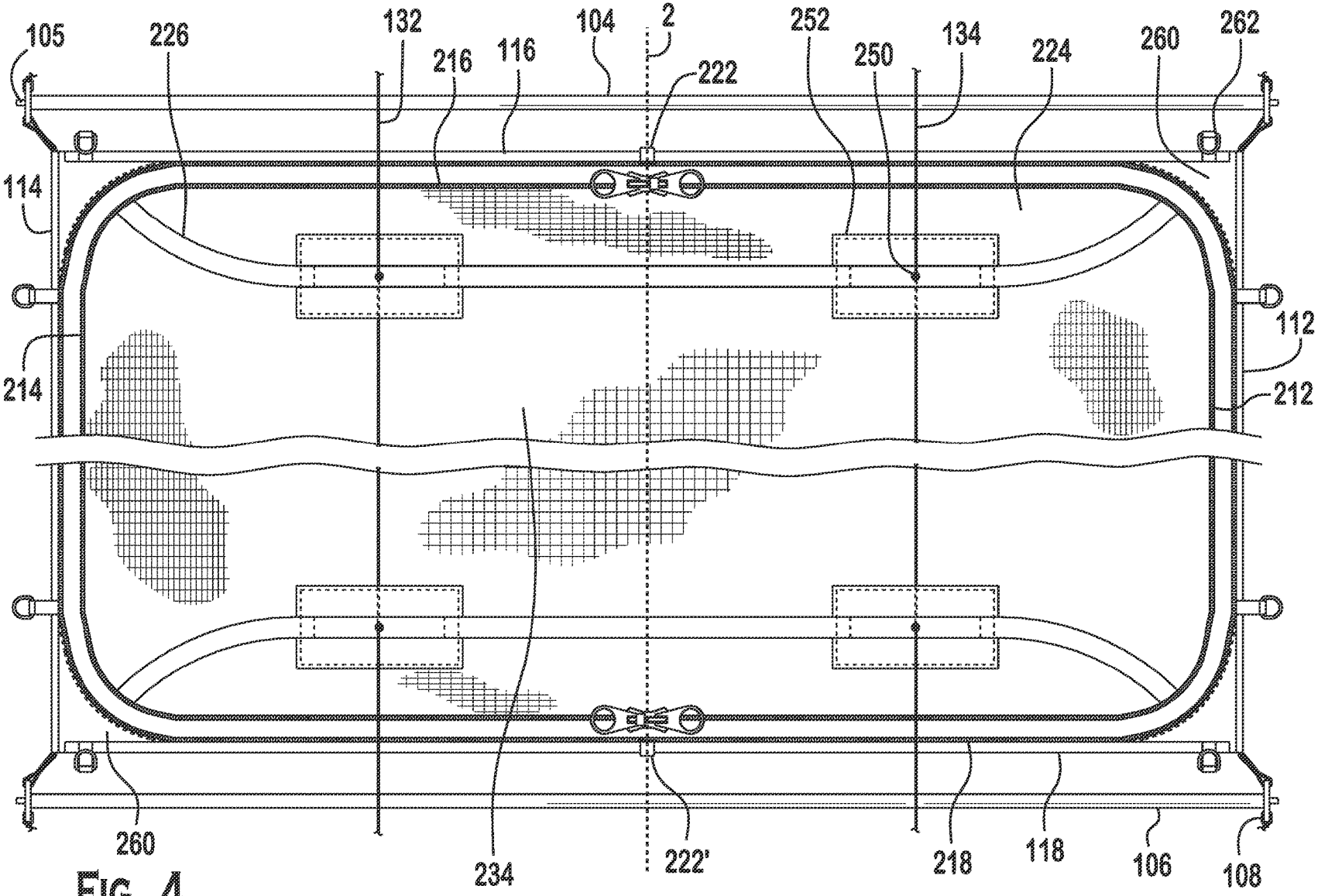
FIG. 4 is a partial plan view of the hammock system of FIG. 1, with the cover positioned above the hammock body, before the cover and the hammock body are connected.

With reference to FIG. 4, along each of the first and second short edges 116, 118 of the hammock body 110 there are provided first and second spreader bars 104, 106. The spreader bars serve to maintain the hammock body in an expanded state, where the long edges are maintained separate, and prevented from collapsing against each other, as would occur with a gathered end hammock. The spreader bars 104, 106 may be provided as linear poles that are capable of maintaining their linear shape even when the hammock is loaded with the weight of an occupant and gear. In an embodiment, each of the spreader bars 104, 106 may be any suitable material or composite materials, including but not limited to materials such as fiberglass, wood, carbon fiber, polymer, or metal, such as aluminum, titanium, and steel, as non-limiting examples.

It is contemplated that the first and second spreader bars 104, 106 may both be of the same construction or materials, or may have different construction or materials. It is also contemplated that the first and second spreader bars may be of the same dimensions, or alternatively may be varied in one or more dimensions. In an embodiment, the spreader bars 104, 106 may be varied in length, such as may usefully provide for a wider hammock opening at one end, and a narrower opening at the other end. In an embodiment, the first spreader bar 104 may be employed as a head end spreader bar, and is of a greater length dimension than the second spreader bar 106 employed as a foot spreader bar. In an embodiment the first spreader bar is to be deployed at the head end of the hammock 100. In an embodiment, the second spreader bar is to be deployed at the foot end of the hammock 100. As can be seen in FIG. 4, the length of at least one of the spreader bars should be at least as long, and preferably slightly longer than the short edge 116, or width dimension, of the hammock body 110 when suspended.

In an embodiment, one or both of the spreader bars 104, 106 may be non-collapsible and thus be of a fixed length. In another embodiment, one or both of the spreader bars 104, 106 may be collapsible and may comprise one or more sections fitted together at a connection to join the sections, or rigidly secure the sections together. Such collapsible spreader bars are well known for camping purposes, and may feature a plurality of rigid pole sections that assemble together to form the spreader bar 104, 106. It is contemplated that a collapsible spreader bar may thus be collapsed by separating the component sections, each having a shorter length than the assembled spreader bar, with the shorter sections of the spreader bar components allowing for convenience in transport when disassembled, and the spreader bar components are configured to be reassembled for use.

In an embodiment of the collapsible spreader bars, there may be provided an internal elastic cord running within the sections, such that the sections can folded against each other, and remain flexibly connected when collapsed. In an alternative embodiment, the spreader bars may feature one or more telescoping sections, such that when collapsed, at least one section may fit, or nearly fit, within the dimensions of another section, and may be extended out and secured relative to the other, thereby forming a longer pole than when the telescoping sections are retracted. In still another embodiment, the spreader bars may be collapsed by separating into a plurality of shorter sections, and be capable of reassembly, with the ends of the sections engaging with at least one adjoining section in forming the spreader bar. Such sections may fit together with an adjoining section in any manner suitable known in the art; for example, in a male/female relationship with the end of one section accepting the complementary end of another section, as will be familiar to those skilled in the art; or alternatively employ a coupler fitting (not shown) to receive each of the ends of adjoining poles to be secured together.

In any of the embodiments of the spreader bars 104, 106 deployed with the hammock 100, the spreader bars may be secured along each of short edge 116, 118 of the hammock body 110, to maintain the hammock body in an open configuration in a width orientation, and serve to prevent the narrow collapsed hammock configuration as would happen with a gathered end hammock. As can be seen with reference to FIG. 4, the securement of each of the ends of the spreader bars 104, 106 may be achieved by placing each end of the spreader bars into a receiver that is mechanically coupled to the corners of the hammock body 110. In an embodiment, the hammock body 110 is provided at each of its corners with a pocket or grommet that receives the ends or tips of the spreader bars. Alternatively, as depicted in FIG. 4, the spreader bars 104, 106 may be received into a hammock end corner hardware component 108 that is connected to or mechanically linked to the corners of the hammock body 110, such as by a flexible connection, which may be, for example, cord, rope, or webbing material suitable for withstanding the expected load. The hammock end corner hardware component 108 may be any suitable material, such as fabric, metal, polymer, or carbon fiber, and provide an opening into which the end of the spreader bar may be secured. In an embodiment, the end of the spreader bars 104, 106 may have a tip 105, such as a narrowed portion, that is configured to be received within an opening in the hammock end corner hardware component 108, but the opening is sized to prevent the passage of the rest of the spreader bar therethrough.

The hammock end corner hardware component 108 may itself also be mechanically connected to the suspension system 120 for the hammock, and may optionally have a receiver for attachment of accessories such as bags, or hanging an under quilt from the hammock end corner hardware 108 at each corner of the hammock body. In an alternative embodiment, each corner of the hammock body 110 directly connected to one of the suspension devices 127 of the suspension system 120 (discussed below), with the spreader bar fitting into a pocket or grommet incorporated into the hammock body 110 (not shown).

Hammock Suspension System

Figure 3:
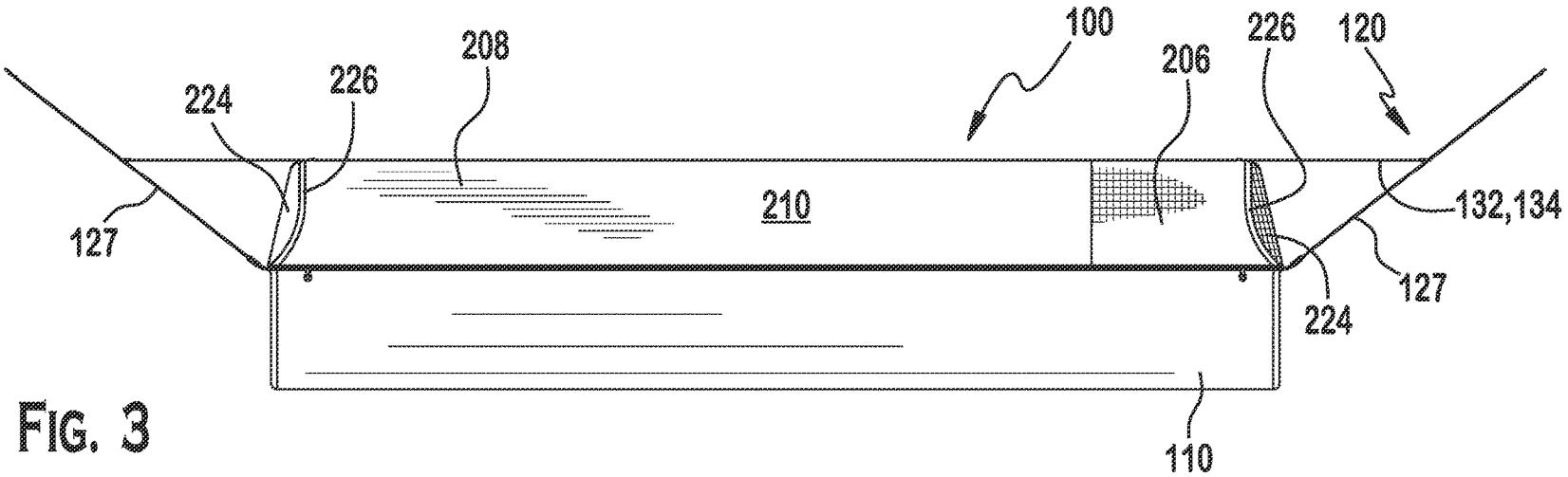
FIG. 3 is a side view of the hammock system of FIG. 1.

With reference to FIGS. 1-3, the hammock suspension system 120 is shown supporting each short edge 116, 118 of the hammock body 110. As depicted in FIG. 1, the hammock 100 is suspended between a pair of supports S for the hammock to be hung there between. Each of the supports S may be any suitable item capable of supporting the weight of the loaded hammock 100, such as trees, buildings, rocks, or hammock stands. Each of the supports are spaced apart at a suitable distance that allows the hammock 100 to be suspended between the pair of supports, without the hammock body 110 encountering the ground when occupied. As shown, the suspension system 120 a pair of suspension devices 127, forming a suspension triangle extending out from each of the short edges 116, 118 at each end of the hammock body 110. Each suspension triangle is formed by each of the suspension devices 127 being attached to, or near the corners of the hammock body 110, and extended towards the respective hammock support, meeting at an anchor point 122, 124, which may be directly on the support, or alternatively, the anchor point may be part of an anchor suspension system, such as a strap and/or buckle system that is adjustably secured to the support, as is familiar to those skilled in the art.

Referring to FIG. 1, the suspension devices 127 are lines attached at one end ear the corners of the hammock body 110, as shown, the ends are mechanically linked to the ends of spreader bars 104, 106 (discussed below), and the suspension device 127 lines extend away from the hammock 100 towards the respective anchor point 122, 124, here depicted as a buckle adjustable on a strap secured to the support S. In this manner, the hammock 100 may be secured between supports and can accommodate a range of distances between the selected supports, by adjusting the anchor suspension system, as is familiar to those skilled in the art.

The suspension devices 127 of the hammock suspension system 120, as shown in FIG. 1-3, is configured to suspend each of the corners of the hammock body 110, by lines under tension between the anchor point and the spreader bars. The material of the suspension devices 127 must be strong enough to support the anticipated loads of an occupied hammock, preferably with minimal or no stretch in the lines, which would otherwise negatively affect the hang of the hammock 100 when occupied. In the shown embodiment, the suspension devices 127 are ropes formed of nylon, polypropylene, polyethylene, ultra-high-molecular-weight polyethylene, or any other lightweight, durable material known in the art, and may have a knot, loop, or a suitable fastener incorporated in the ends for ease of securement.

Cover

The removable cover 200, shown generally in FIGS. 1-3, includes a cover body 210 having a cover first long edge 212 and an opposite cover second long edge 214, and a cover first short edge 216 and a cover second short edge 218. The cover body 210 may be formed of at least a first material 206. As depicted, the cover body 210 may be a netting formed of nylon, cotton, silk, polyester, polypropylene, polyethylene, or any other durable netting materials known to those with ordinary skill in the art. The netting of the first material 206 has a hole size sufficient to permit ventilation and visibility, while preventing insect penetration, such as NO-SEE-UM or NANO NO-SEE-UM netting.

Alternatively, the cover body 210, may comprise a first and second material 206, 208, as depicted in FIG. 3, with the first material 206 being the previously described netting material, and the second material 208 being formed of a durable, wind-resistant and water-resistant material. Suitable materials for the second material 208 include, as non-limiting examples, nylon, such as ARGON 90, cotton, silk, polyester, polypropylene, polyethylene, polytetrafluoroethylene, or any other suitable durable, wind-resistant, water-resistant material known to those with ordinary skill in the art. The second material 208 may be reinforced with a ripstop pattern. The second material 208 may be the same, or different from the material comprising the hammock body 110.

Each of the first long edge 212 and the second long edge 214 of the cover body 210 are of lengths, as shown in FIG. 2, that generally correspond to those dimensions of the hammock body 110. The perimeter of the cover body 210 may be detachably secured to the hammock body 110 using a zipper fastener system 1 described herein. In an embodiment where the hammock 100 when suspended is asymmetrical, such as by having a greater length for the first spreader bar 104 at a first end, and a shorter length for the second spreader bar 106 at the second end, the hammock cover 200 may need to similarly match the varied dimensions of the hammock body 110. In such an instance, the cover body 210 may be marked or otherwise identify one or both of the ends, so that the cover body 210 can easily be oriented properly for securement to the hammock body 110. In an embodiment, the cover body 210 may be labelled at a first end with a suitable location identifier 222, such as a tag or other suitable marker having a first color, symbol or identifier that corresponds to a corresponding location identifier 222, such as matching tag applied at a first end of the hammock body 110. Additionally, the cover body 210 may be labelled at a second end with a location identifier 222', such as a tag or marking having a second color, symbol, or identifier, that is distinguishable from the first location identifier 222. The second end location identifier 222' on the cover body 210 corresponds to a matching second location identifier 222' tag applied at a second end of the hammock body 110. It is recognized that, only one end of the hammock components (cover and hammock body) need be marked, as the absence of a marker could serve to indicate the unmarked ends correspond to each other. In another alternative embodiment, the cover 210 may additionally, or alternatively, be keyed such that it may be possible to secure to the hammock body in only one orientation, such keyed joining components may be provided in the form of non-matching zipper components at the first and second ends, that prevent the hammock cover 200 and body 110 from being secured to each other in the improper orientation.

In order to provide a spacious canopy for the occupant when the hammock 100 is suspended properly, the cover body 210 may include a pair of end panels 224 that are joined at a seam 226 to the main portion 230 of the cover 200, as shown in FIG. 2. The seam 226 for the cover, for example as depicted in FIGS. 1-5, may be formed by any suitable method, including sewing, gluing, welding or any other means of attachment known to those with ordinary skill in the art, and may optionally be reinforced with webbing material to distribute loads when suspended by one or more ridgelines, as will be discussed.

Cover Suspension Lines

In an embodiment of the hammock 100, and as depicted in FIG. 1, the hammock cover 200 may be suspended above the hammock body 110 by a cover suspension system 130. The cover suspension system provides at least first and second cover suspension lines 132, 134. Each of the first and second cover suspensions lines 132, 134 may be a cord formed from nylon, polypropylene, polyethylene, ultra-high-molecular-weight polyethylene, or any other lightweight, durable material known in the art. Each of the cover suspension lines 132, 134 are secured at their ends to one of the hammock suspension devices 127 that support the hammock body 110. The point at which the cover suspension lines 132, 134 are secured to the hammock suspension devices 127 is at any suitable point along the length of each of the suspension devices 127 between the hammock body 110 and the respective anchor point 122, 124, typically at, or near the midpoint of the length of each hammock suspension device 127, so as to ensure that the cover suspension lines 132, 134 will be extended at a height that is above the hammock body 110, and also ensures that there will be spacing between first and second cover suspension lines 132, 134 (as can be seen in FIG. 2). In this manner, the dual cover suspension lines 132, 134 serve to create a more expansive canopy enclosure above a substantial width of the hammock body when compared with the enclosed area created through the previously known use of a single ridgeline for the canopy, as at least approximately 50% of the hammock width would be underneath the portion of the cover suspended between the cover suspension lines, as can be seen with reference to FIG. 2. This is in contrast to the use of the previously known single ridgeline systems, which would have a single line extended along the longitudinal axis between supports, and centered above the length of the hammock body, resulting in a high canopy only where the canopy is supported by the ridgeline, and the canopy height above the hammock body would immediately begin decreasing as the distance away from the centerline increases, generally along the plane created from the single ridgeline to the hammock side edge. The present invention provides an improved canopy for the occupant, by providing a hammock 100 incorporating a dual cover suspension system 130 that creates a more expansive canopy due to the cover being supported along two lines spaced apart above the hammock body such that the cover has a central, generally planar portion 234 of the cover 200 that lies in a substantially horizontal and planar form in the portion of the cover, as depicted in FIG. 2, that is defined in the longitudinal direction by the boundaries of the two cover suspension lines 132, 134, and in a latitudinal direction by the boundaries of the seam where the end panels 224 of the cover 200 are joined with the main portion 230 of the cover 200. Additionally, the enclosed volume under the cover is maximized for the occupant due to the angle at which the side panels 238 of the cover 200, representing those portions of the cover 200 that are angled from the cover suspension lines 132, 134 downwards to join with the long edges 112, 114 of the hammock body 110, and forming a generally planar surface which is much nearer to vertical than would occur with a single centered ridgeline. That is due to the dual cover suspension lines 132, 134 being laterally spaced apart from the longitudinal centerline of the hammock body (represented by the dashed line between anchor points 122, 124, and thus the plane created from each of the cover suspension lines 132, 134, to the hammock side long edge 112, 114 is necessarily more vertical than the plane that would be formed with the previously known single ridgelines suspended at a similar height, along the centerline, and the plane formed to the hammock edge. In an embodiment, the angle at which the side panels 238 of the cover 200 drops down to be joined to the long edge 112, 114 of the hammock body 110 is greater than approximately 55 degrees, greater than approximately 60 degrees, greater than approximately 65 degrees, greater than 70 degrees from horizontal, where for reference, a horizontal plane would be oriented at 0 degrees, and a vertical plane would be oriented at 90 degrees. As can be seen in FIG. 2, the hammock 100 has a central longitudinal axis 2, corresponding to the imaginary line between the anchor points of the hammock 100. In the depicted embodiment, each of the cover suspension lines are equidistant or alternatively, located closer to an imaginary line along the long edge 112, 114 of the hammock body that is closest to that cover suspension line 132, 134, than the central longitudinal axis 2 of the hammock 100. Thus, the cover of the present invention, featuring a horizontal planar portion 234, and the more vertical side panels 238, provides an enclosed canopy space within the cover that is of much greater volume than would occur with the previously known single ridgeline systems. In an embodiment, approximately 50% of the enclosed hammock width would lie underneath the horizontal planar portion 234 of the cover 200 that corresponds to the highest point of the cover 200.

As can be seen with reference to FIG. 1, each of the first and second cover suspension lines 132, 134 are configured to extend from the attachment point with one of the suspension devices 127 at a first end of the hammock, and are extended towards a complementary suspension device 127 at a second end of the hammock 100. The cover suspension lines 132, 134 should not cross each other when properly positioned. In this manner, the pair of first and second cover suspension lines 132, 134 can be seen to extend generally longitudinally above the length of the hammock body 110, and is parallel, or nearly parallel to the longitudinal axis 2 of the hammock 100. It is recognized that in some embodiments, the cover suspension lines 132, 134 need not necessarily be parallel to each other, nor necessarily parallel to the longitudinal axis of the hammock body, as the axis for each of the cover suspension lines 132, 134 may be varied somewhat away from parallel based on locations of the respective attachment points for each end of the cover suspension lines 132, 132, or on the hammock 100 configuration itself. For example, in an embodiment of the hammock 100 where the first and second hammock spreader bars 104, 106 provided are of unequal length, there may be a wider angle created between the suspension devices 127 extending from the anchor point 122 towards the ends of the longer spreader bar, and a narrower angle created at the other end of the hammock 100 between the suspension devices 127 extending from the other anchor point 124 towards the ends of the shorter spreader bar. In such an instance, the first and second cover lines 132, 134 may be non-parallel, if only due to the differences of the angles created by the opposing suspension triangles at each end of the hammock body 110.

Figure 8:
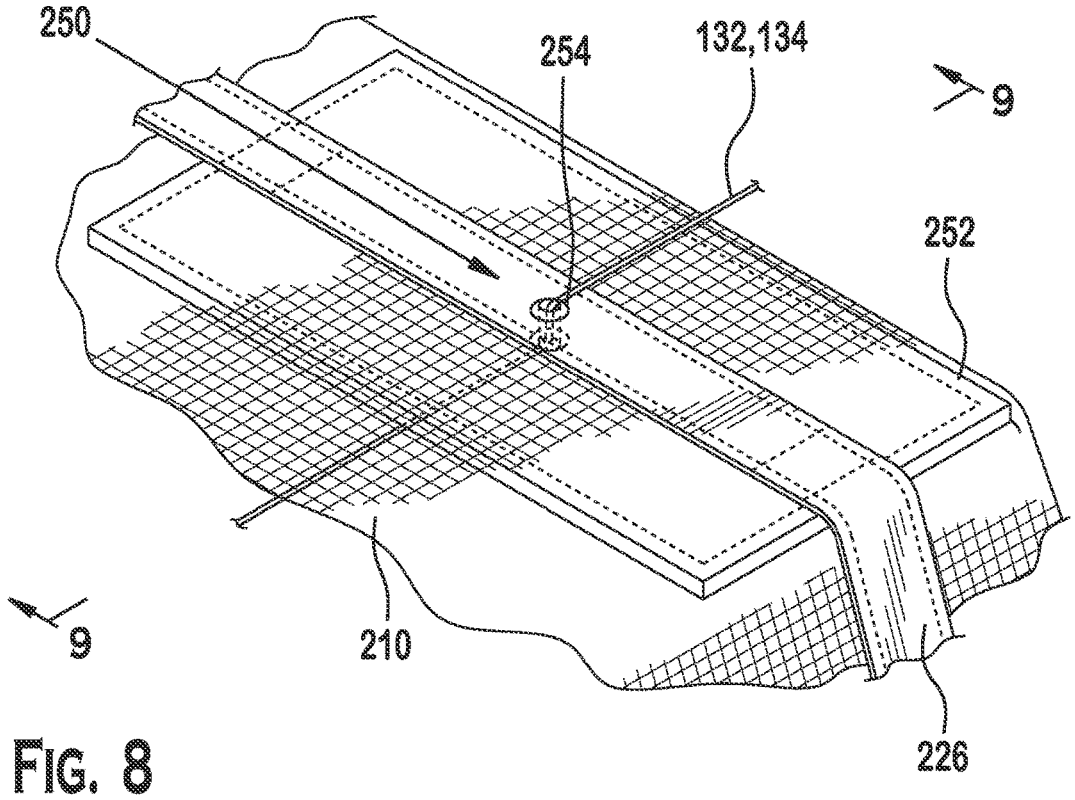
FIG. 8 is a close up, partial, perspective view of the cover depicting the cover suspension line traversing through a passage.
Figure 9:
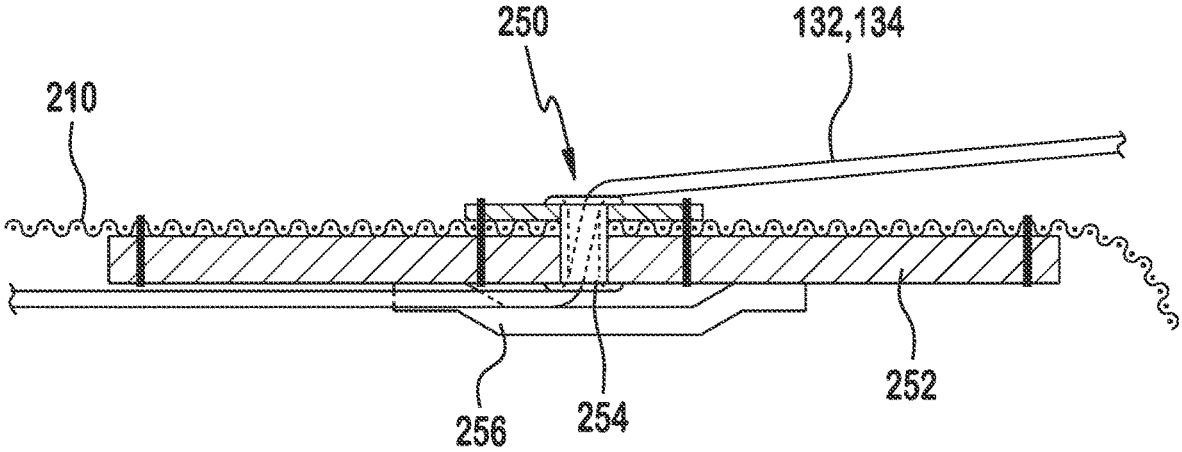
FIG. 9 is a section view of the cover and passage, along line 9-9 of FIG. 8.

As can be seen with reference to FIGS. 1 and 4, and as shown in expanded view in FIGS. 8 and 9, each of the cover suspension lines is extended between their attachment points to opposing hammock suspension devices 127. When examined along their length, each of the cover suspension lines 132, 134 is configured to pass from the exterior of the hammock cover 200 to the interior of the hammock cover at a passage 250, support the length of the hammock cover 200 from the interior, and then exit from the interior of the hammock cover 200 to the exterior of the hammock cover at another passage 250. The first and second passages 250 are located at, or near, the seam 226 in the hammock cover 200, where the end panels 224 are joined to the main portion 230 of the hammock cover. In this manner, for each of the cover suspension devices 132, 134, the length extending between the first and second passages 250 is serving to suspend the hammock cover 200 above, and approximately the length of the hammock body 110 (as shown in the side perspective view of FIG. 3).

As depicted in FIG. 4, each of the first and second passages 250 through the hammock cover 200 may be placed through a reinforcement material 252, which may be a durable flexible material, such as webbing, secured to the material of the hammock cover 200. The reinforcement 252 sheet may be capable of distributing the forces created by suspending the hammock cover 200 over a larger portion of the cover 200 than just the point of the passage 250 itself, thereby serving to prevent concentration of stresses that might rip or damage the cover body 210.

For each of the passages 250 in the hammock cover, there may be provided a grommet 254, which creates or maintains the opening through which a cover suspension line 132, 134 may pass, as can be seen in the cross-sectional view of FIG. 9, viewed along the cross section along the line 9-9 of FIG. 8. The grommet 254 may be formed from a flexible material, such as elastomeric polymer, or the grommet may be a rigid material, such as a metal or rigid polymer. The grommet 254 may serve to prevent damage to the cover 200 attributable to the cove suspension devices 132, 134 being extended through the passage 250, and may serve to prevent tears due to loading stresses, or prevent damage to the cover 200 from the friction of the cover suspension line 132, 134 moving with the passage 250. In an embodiment, the passage 250 opening may be created in any of the hammock cover 200, or reinforcement material 252 along with the hammock cover 200, and the opening reinforced with thread stitching around the opening, similar to stitching around a buttonhole. Similarly, the reinforced opening for the passage 250 may be created at the location the grommet 254 is inserted through the hammock cover 200.

Optionally, each of the first and second passages 250 for the dual cover suspension devices 132, 134 may be reversibly sealed, such that when the passages 250 are sealed, they may beneficially serve to prevent the penetration of insects or precipitation through the passage opening to the enclosed volume, but can be unsealed to allow the insertion of a cover suspension line 132, 134 therethrough. In an embodiment, the seal is provided by a repositionable flap 256 that can be positioned to cover or rest against the passage opening after the cover suspension line 132,134 has been placed through the passage 250. The repositionable flap 256 may be removed, or positioned away from the passage, in order to facilitate the insertion of the cover suspension line 132, 134, or the removal thereof, from the passage 250. In an embodiment, the repositionable flap 256 relies on a hook and loop securement system, as is well known, for example, where the reinforcement material 252 provides either the hooked or looped surface, and the repositionable flap 256 presents a surface with the opposing hooked or looped surface, as appropriate, such that the flap 256 may be secured, and repositioned repeatably. In an exemplary embodiment, the reinforcement material 252 is provided with a looped material surface, which can repeatably engage or release the hooked material surface of the repositionable flap 256. In an alternative embodiment, the sealing of the passage opening may be provided by inclusion of an elastomeric material or other deformable suitable sealing material, either as part of, or secured to any of: the hammock cover 200, the reinforcement sheet 252, or the grommet 254. Such a sealing material may form an opening when squeezed or manipulated, to facilitate the insertion or removal of the cover suspension line through the passage, and when released or relaxed, the elastomeric material conforms around the cover suspension line to form a bug-proof and/or rainproof seal. An example of a suitable elastomeric seal can provided in a manner analogous to a duckbill valve, or a squeeze opening coin-purse, where the opening is compliant and may be enlarged by squeezing the sides of the valve or distorting the elastomeric material, and the opening tightens to a narrowed slit or presents a closed seal around the cover suspension line 132, 134 when released. Alternatively, the passage 250 openings may be sealed from the exterior by placing a cover over the first or second passages, for example, a plug or repositionable material may be advanced along, or placed against the cover suspension line 132, 134 to seal the first or second passage 250.

Zipper Fastening System

The various embodiments of a hammock 100 described herein may be provided with a zipper fastener system 1, enabling the reversible securement of the cover 200 to the hammock body 110. A zipper fastener system 1 according to the invention is shown in FIGS. 4-7. Generally, the zipper fastener system 1, as seen with reference to FIGS. 4 and 5 can be seen to provide a pair of two-way, closed-ended zippers 50, each of which can be seen to extend along the entire length of the long edges 112, 114 of the hammock 100, and continue at least partially along each of the short edges 116, 118 of the hammock 100, and thus collectively, encircling the perimeter of the hammock body 110. One tape for each of the zippers 50 can be attached to the hammock body 110 near the perimeter using stitching, mechanical weld, or adhesive. The other tape for each of the zippers 50 can be attached to the cover body 210 near the perimeter using stitching, mechanical weld, or adhesive. In the embodiment shown in FIG. 4, each of the zippers 50 is a two way, closed-ended zipper, thus the zipper operates by being closed first at the opposing ends of the zipper, and is configured to be closed from both ends by advancing the zipper sliders along the zipper, as will be discussed.

A two-way, closed-ended zipper 50 provides at each end of the zipper, a zipper slider 30 with at least one zipper pull tab 32 and a retainer box 36 on a first tape. The retainer box 36 on the first tape is configured to receive the insertion pin 38 of a second tape, after it has been directed through the zipper slider 30. Subsequently, that end of the zipper 50 is capable of being closed by advancing the zipper slider 30 along the zipper length to engage the teeth 19 and thereby mate together the first and second tape portions 10, 20, starting from the retainer box 36. Similarly, the other end of the same zipper is configured similarly, and can be zipped in the same manner. As the zipper slider 30 is advanced towards the opposite end of the zipper, and towards the other zipper slider 30 on the same zipper, the portion of the length of the zipper remaining between each of the zipper sliders 30 on the same zipper 50 remains open. The portion of the zipper where the teeth have not yet been engaged to close that portion of the zipper, remain separate until the zipper slider has advanced over that portion. It is only as the slider is advanced over that the teeth of the first tape 10 and second tape 20 on the zipper become mated with each other, thereby closing that portion of the zipper. The second two-way closed-ended zipper 50 is of duplicate construction, and can be operated similarly. Thus the zipper slider 30 for the second zipper 50 is advanced away from the retainer box 36 at one end of the zipper 50 and the teeth of each of the third zipper tape 11, and fourth zipper tape 21 become engaged to close that portion of the zipper 50. In this manner, each of the two zippers 50 provided on opposing sides of the hammock is configured to be zippered from either or both of the first end and/or second ends of the hammock 100.

With reference to FIG. 4, there is depicted a plan view, showing the suspended hammock cover 200 overlaid over the suspended hammock body 110. As shown, the cover 200 is not yet secured to the hammock body 110 through the use of the zipper fastener system 1. Each of the sliders 30 for each of the zippers 50 are positioned against their respective retainer box (not visible in FIG. 4), ready to receive the insertion pin on the opposing zipper tape, for closing the zipper, as will be discussed. For ease in positioning the cover 200 for mounting, the zipper sliders 30 and retainer box may be positioned adjacent to a location identifier 222 on the hammock body 110. As discussed, the cover 200 may be provided with a corresponding location identifier, to facilitate the aligning of the cover 200 in proper position to allow securement to the hammock body 110.

Figure 5:
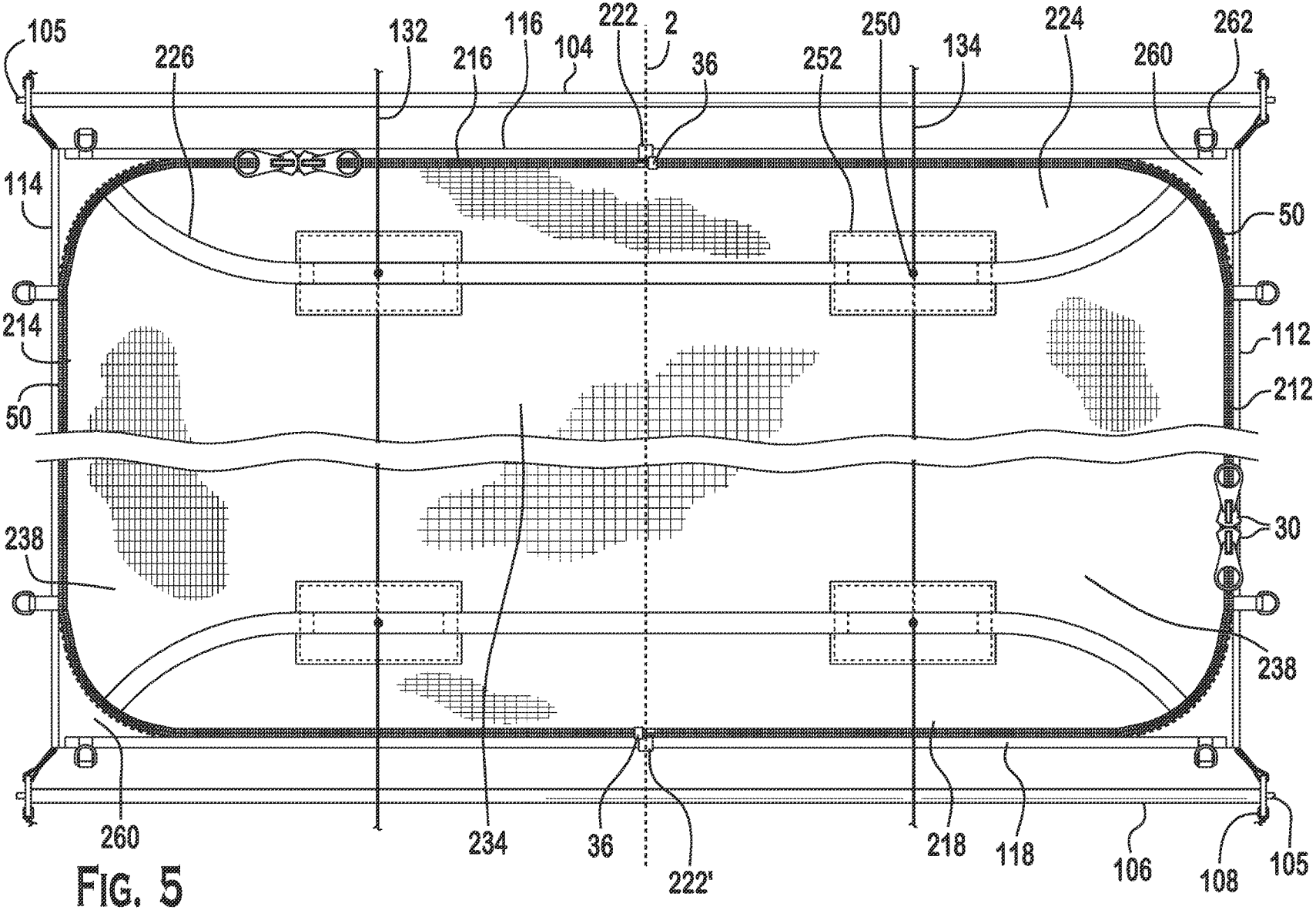
FIG. 5 is a partial plan view of the hammock system of FIG. 1, showing the securement of the cover to the hammock body by connecting the first and second tape sections.

With reference to FIG. 5, once the insertion pin for each end of the zippers 50 is directed through the respective zipper slider 30, and into the respective retainer box 36, the zipper slider may be advanced away from the retainer box, in order to close the portion of the zipper 50 over which the slider has been advanced. As depicted in FIG. 5, both of the zipper sliders 30, on each of the opposing zippers 50, have been advanced along a portion of their respective zipper, and once the two sliders 30 on the same zipper encounter and are abutting each other as shown, the entire length of that zipper 50 has been closed. For example, the two-way, closed-ended zipper 50, on the right side of the hammock, as depicted in FIG. 5 has been closed entirely, where the two zipper sliders 30 are tightly against each other.

As depicted in FIG. 5, the zipper fastening system 1 is configured to substantially close and secure the entire perimeter of the cover 200 to hammock body 110 in order to complete the enclosure for the occupant and prevent unwanted penetration through the cover, for example, to prevent the passage of insects into the enclosed area with the occupant. As shown, each of the zippers 50 extend along the entire length dimension along the long edges 112, 114 of the hammock body 110, navigate the corners of the hammock body 110, and extend at least partially along the length of the short edges 116, 118 of the hammock body 110. At each corner of the hammock body 110, there is provided a gusset 260, which may be the same or different material as the hammock body. The gusset 260 is a flexible material that is joined at the periphery of the hammock body near the corners, and extends generally towards the interior of the hammock to allow for a gradual curve for the zipper 50, ensuring that the zipper sliders 30 can be advanced past the corners to close the zippers 50, even when under load from an occupant and gear. The dimensions of the gusset 260 may be such that the bend radius of the zipper 50 at the corner is prevented from being so small that it would hinder the travel of the slider 30 along the zipper. That is, the gusset 260, even under load, is useful to smoothly distribute the loading forces that would otherwise be concentrated at the corner, and thereby avoids the creation of a sharp bend in the tapes 10, 20, 11, 21 of the zipper 50 that would be difficult for the slider 30 to navigate. Furthermore, in the absence of gusset 260 at each of the corners, high tension in the corners would also tend to pull the zipper tapes 10, 20, or 11, 21 apart from each other, making it difficult to advance the slider 30 past the corner when loaded, or potentially damaging the zipper. The gusset 260 thus serves to move the zipper tapes inward, and away from the corner, and can reduce, or isolate the zipper tapes from the loading that would tend to pull the opposing zipper tapes apart. The incorporation of the gusset 260 at each corner of the hammock body 110 is therefore necessary to prevent the creation of a sharp bend where the zipper 50 must transition from being extended along the long edges 112, 114 of the hammock body 110 to be oriented along the short edges 116, 118 of the hammock body 110, and beneficially prevents the tapes pf the zippers 50 from being strongly pulled apart at the corners, thereby making it possible for one to operate the zipper smoothly, even when the hammock body is bearing an occupant and associated gear.

Figure 6:
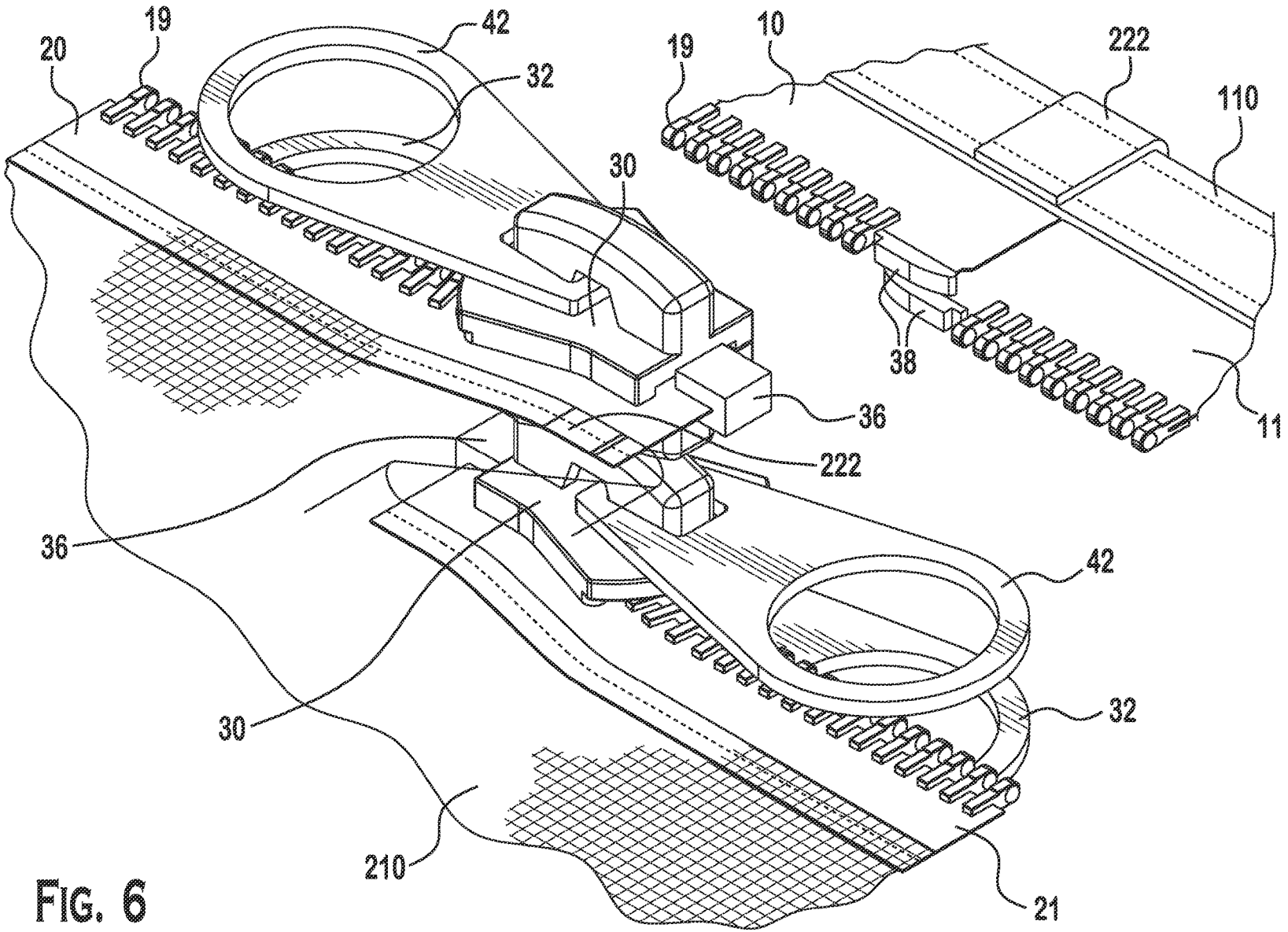
FIG. 6 is a close up perspective view of the zipper fastener system according to the invention before the tape sections are connected.

Aspects and operation of the zipper fastener system 1 will be discussed in detail with regard to FIGS. 6 and 7. With reference to FIG. 6, at both of the first and second ends of the hammock (of FIGS. 1-5) there are provided the depicted components for the pair of the two-way, closed-ended zippers 50 that are utilized to secure the cover 200 to the hammock body 110. Depicted in FIG. 6 is a first tape section 10, a second tape section 20, a third tape section 11, a fourth tape section 21, a pair of sliders 30 one for each zipper 50.

The first tape section 10 is configured to be secured to second tape section 20. The third tape section 11 is configured to be joined to fourth tape section 21. The slider 30 for the first of the zippers 50 is configured to be advanced along the first and second tape sections 10, 20 to engage the teeth together and secure the tape sections together. The other slider 30 for the second of the zippers 50 is configured to be advanced along the third and fourth tape sections 11, 21 to engage the teeth together and secure the tape sections together. Each of the two sliders 30 are provided with an inner pull tab 32, and outer pull tab 42, such that each of the zipper sliders may be manipulated from either inside or outside the enclosed space of the hammock 100 and cover 200. As shown, the retainer boxes 36 for each of the second tape section 20, and the fourth tape section 21 are in close proximity, and positioned so as to have at least some overlap, when viewed from above, between the second tape section 20 and the fourth tape section 21. In this manner, when the cover 200 is being prepared to be secured to the hammock, both of the sliders 30 for the first and second zippers 50 would be generally in vertical alignment with each other, albeit reversed orientation, as shown.

Figure 7:
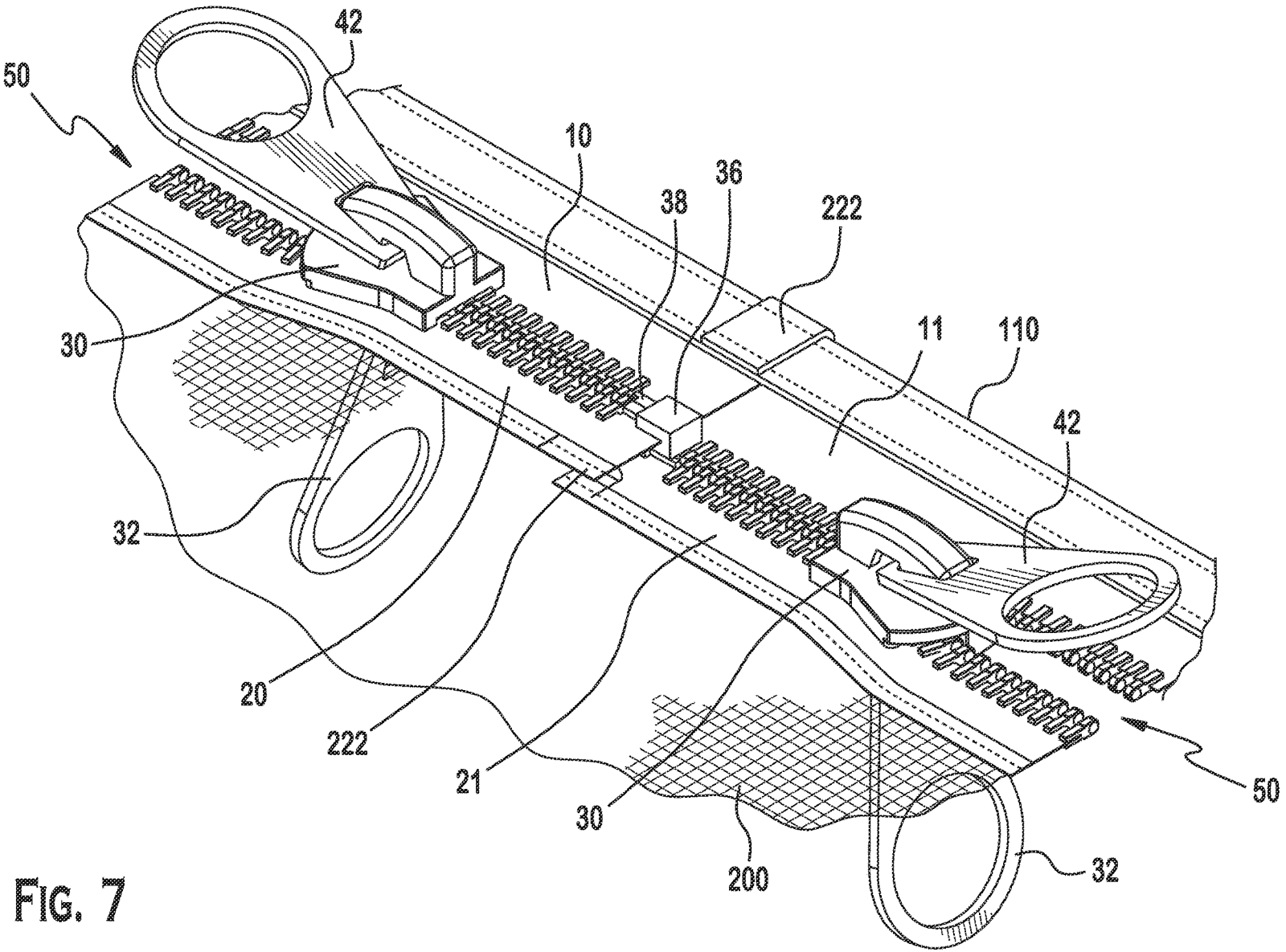
FIG. 7 is a close up perspective view of the zipper fastener system of FIG. 6 after the tape sections are partially connected.

FIG. 7 depicts the same zipper ends from FIG. 6, only with both of the two-way, closed-ended zippers 50 partially zipped. As depicted, the zippered sections are formed by mating together the first tape section 10 to the second tape section 20, and similarly the third tape 11 section to the fourth tape section 21. Notably, there is at least some overlap between the zippered sections, so as to have the zippered sections lie flat against each other, and ensure that there is substantially no gap created where the ends of the zippers 50 meet. This is necessary so as to avoid allowing penetration, such as by insects, into the enclosed area, as the overlapping zipper portions can lie flat against each other. In the embodiment depicted in FIGS. 6 and 7, the retainer box 36 for each zipper 50 is provided on the cover 200, and the insertion pin 38 for each zipper 50 is provided on the hammock body 110. One skilled in the art will understand that the placement of the zipper elements (retainer box, slider, and retainer pin) may be reversed, to provide the insertion pin elements on the cover, and the zipper sliders and retainer boxes on the hammock body 110. Alternatively, it is contemplated that the components may be mixed, and function similarly within the spirit of this disclosure. For example, it is contemplated that on the same zipper, it may be possible to provide an orientation of retainer box and insertion pin at one end, and reverse the orientation at the other end.

The two-way, closed-ended zippers 50 would provide the same zipper components depicted in FIGS. 6 and 7 at both ends of the hammock 100, as can be seen with reference to FIG. 4. In this embodiment, each of the zipper sliders 30 can be advanced from the start position at its retainer box 36, and along the perimeter of the cover 200, until encountering the opposing zipper slider 30 on the same zipper, thereby closing that zipper entirely. When both of the two-way, closed-ended zippers 50 (on the left and right side of the hammock) are fully closed as described, the entire perimeter of the cover 200 is then secured to the hammock body 110 with substantially no gaps. This is beneficial, for example, in an embodiment where the cover 200 is a mesh serving to prevent the penetration of insects through the cover, once the cover 200 is fully secured to the hammock body 110, there would be no open gaps, thus the occupant would remain shielded from insects, so long as the zippers 50 remained closed.

For ease of entry into, exit from, or access to, the interior of the hammock 100, the user may open one side of the hammock by retracting at least partially one or both of the zipper sliders 30 on one of the two-way, closed-ended zippers 50, thereby creating an opening where the zipper tapes are disengaged and that portion of the cover 200 is not secured to the hammock body 110. Full retraction of both zipper sliders 30 from the two zippers 50 of the hammock will release the cover 200 from the hammock body 110. To remove the cover 200 for storage, the cover suspension lines would be removed from the passages 250 of the cover.

Storage Bags

It is contemplated that for storage, the hammock 100 and associated components thereof may be provided in container, such as a storage bag, known in the art as a stuff sack (not shown). In an embodiment, the cover may be provided with a separate cover stuff sack, distinct from the stuff sack used for the hammock body and suspension components. In an embodiment, the cover, when stored in a cover stuff sack, may be placed within the stuff sack along with the other hammock components for storage and transport together. In an embodiment, the stuff sack is capable of being opened at both ends, and has a closure mechanism, such as a drawstring, provided on first and second opposite sides of the stuff sack, such that the hammock body and one of the suspension components can be deployed from one end of the stuff sack, and the other suspension component can be deployed from the other end of the stuff sack, thereby allowing the user to keep the stuff sack retained on one of the hammock suspension triangles, so as to not be separated from the rest of the hammock 100, to prevent loss. When packing up the hammock 100, the user can re-insert the components of the hammock into the stuff sack, and secure by closing the drawstring(s) to prevent escape of the components. In an embodiment, the stuff sack may be entirely removable from the rest of the hammock components. Any of the embodiments of the stuff sack described herein may be formed of any suitable fabric material, including as non-limiting examples, nylon, cotton, silk, polyester, polypropylene, polyethylene, polytetrafluoroethylene, or other lightweight, durable fabrics, and may be reinforced with a ripstop pattern such as a HEXON ripstop grid.

Accessory Clips

The hammock body 110 or cover 200 may be provided with accessory clips 262 at various locations. The accessory clips may be provided as D-rings, as will be familiar to those of skill in the art. The accessory clips 262 may be secured to the hammock body 110 or cover 200 directly or to webbing or other flexible material that is secured to the hammock or cover, as depicted in FIGS. 4 and 5. The accessory clips 262 may be provided along the perimeter of the hammock 100, as may be useful for securement of a hammock underquilt thereto. The accessory clips may be placed outside of the hammock enclosure with the cover 200 secured in place as described herein, or alternatively may be placed inside of the enclosure, and accessible to an occupant while the cover is secured in place Use of the Hammock System The use of the hammock 100 will now be described. As depicted in FIG. 1, the hammock 100 may be suspended between any two suitable supports, as is known with other hammocks. From a first side of the hammock 100, extending out from first short edge 116, a pair of suspension devices 127 are then secured to an anchor point 122, which may be directly on the support, or alternatively, to any suitable anchor support system. The other end of the suspension devices 127 are mechanically connected to the hammock body 110 either directly, or secured to hammock end corner hardware 108 that is mechanically connected near the corners of the hammock body 110.

The length of the hammock body 110 may be suspended by repeating the attachment of the suspension devices 127 at the second end of the hammock body to a second support, or another anchor point 122 connected to a second support, such as through an anchor support system.

The first and second spreader bars 104, 106, if they were collapsed for transport, may be assembled to their full-length functional form. Each of the ends for the first and second spreader bars may then be directed into the receivers for the ends of the spreader bars, whether receiving pockets on the hammock body, or into hammock end corner hardware 108, as shown in FIG. 4. As depicted, the spreader bars 104, 106 may be provided with tips 105 that can be fit into the hammock end corner hardware 108. With the spreader bars in place, the short edges 116, 118 of the hammock body 110 are maintained in taught configuration to form the expanded hammock body, as can be seen in FIGS. 1-3. In an embodiment where the hammock is to have a wider end and a narrower end, the longer spreader bar would be put in place at the wide end of the hammock body, and the shorter spreader bar would be put in place at the narrow end of the hammock body. The hammock body 100 is now suspended properly and suitable for an occupant, if the open hammock configuration is desired, and there is no need for the cover 200 to be deployed over the hammock.

Optionally, the user may deploy the hammock 100 with a removable cover 200 that can be suspended over the hammock body 110, as depicted in FIG. 1. The cover 200, as previously mentioned, may be a mesh cover suitable for keeping insects away from the occupant, or alternatively, the cover may feature a portion that is a mesh that allows venting and prevents insect penetration, with the balance of the cover 200 being of a material that can provide some form of additional shelter, such as protection from sun, wind, cold, and rain. To ensure that the length dimensions of the cover 200 and the hammock body 110 are generally aligned, or in an embodiment where the hammock body 110 is asymmetrical, the user may need to confirm that a location identifier 222 for the cover 200 is generally adjacent to a complementary location identifier 222 provided on the hammock body 110. The orientation of the cover 200 is important for the asymmetrical hammock embodiment, as the cover must be properly oriented so as to accommodate the hammock body having a wider head end, and a narrower foot end. In such an instance, cover 200 may be adjusted or rotated so that the location identifier 222, 222' for either or both of the head end or foot end, if any, on the cover is generally aligned near a complementary location identifier on either or both of the head end or foot end of the hammock body 110, as appropriate, thereby ensuring that the cover will conform properly to the dimensions of the hammock body when the cover 200 is suspended above the hammock body 110.

With the cover 200 placed over the hammock body 110 in the appropriate orientation, the respective tapes of each of the zippers 50 may be secured together. With reference to FIGS. 6 and 7, the user directs the insertion pin 38 of the first and third tape section through the opening of the appropriate slider 30 and into the retainer box 36, as appropriate. The sliders 30 for each of the zippers 50 may then be advanced away from the respective retainer box 36, causing the engagement of the teeth and thereby connect the first tape section 10 to the second tape section 20 as the slider 30 for the first zipper is advanced. Similarly, the third tape section 11 is connected to the fourth tape section 21, as the slider 30 for the second zipper is advanced. This process may then be repeated at the other end of the hammock.

With reference again to FIG. 1, the user can then suspend the cover 200 above the hammock body 110 on a pair of cover suspension lines 132, 134 that are to be suspended between opposing pairs of suspension devices 127 as depicted. A first end of a cover suspension line 132 is secured to a suspension device 127. The securing may be achieved using any suitable method, for example, a connection hardware may be provided on each of the suspension devices 127 at an appropriate location, typically near the midpoint of the suspension device, that is midway between the suspension device connections to the spreader bar 104 end and the anchor point 122. The cover suspension line 132 is then directed through the cover 200, passing from the exterior of the cover 200 to the interior of the cover 200 at a first passage 250, where the line may be directed through the grommet 254 and reinforcement 252, if present, as shown in FIGS. 8 and 9. The cover suspension line 132 is then passed through the cover 200 at other end of the cover, passing from the interior to the exterior at a second passage 250, again passing through a grommet 254 and reinforcement 252, if any at the second passage. The cover suspension line 132 is then attached to the suspension device 127 at the other side of the hammock 100. The second cover suspension line 134 is similarly suspended, again passing through the cover at passages 250. At each point the cover suspension lines 132, 134 pass through the cover 200, the user may seal the opening in the passages 250, such as by positioning a repositionable flap 256 over the grommet or the passage opening through which the cover suspension line passes. Alternatively, such as where the passage 250 incorporates an elastomeric seal (such as a duckbill valve), the cover suspension line 132, 134 may be directed through the opening, and the elastomeric material would tend to seal against the line automatically. The cover suspension lines 132, 134, when properly suspended between the pairs of suspension devices 127, are to run alongside each other above the hammock body 110, and should not cross.

The user may then complete the securement of the cover 200 with hammock body 110, by advancing each of the zipper sliders 30 on the same two-way, closed-ended zipper 50 until they abut one another. The user can the repeat the closing of the opening between the cover 200 and the hammock body 110 on the opposite side of the hammock 100, similarly closing the other two-way, closed-ended zipper 50.

To allow entry into the hammock 100, one or both of the zippers 50 may be partially opened by separating the zipper sliders 30 on one or both of the zippers 50, enough that the resulting opening between the cover 200 and the hammock body 110 is large enough to accommodate passage therethrough, such that an occupant can enter the hammock enclosure. Once the occupant is within the enclosure, the sliders 30 for the zippers 50 can be closed fully again to secure the cover 200 to the hammock body 110 and close all of the gaps by having the zipper sliders 30 abutted against each other for both of the zippers 50, as depicted in FIG. 5.

If so desired, the hammock 100 and cover suspension lines 132, 134 may be left in place as the hammock 100 is taken down and directed into the stuff sack for storage and transport. Alternatively, the cover 200 can be removed for storage, or in the event it is desired to completely remove the cover 200, the user can completely unzip both of the sliders 30 on each of the two way, closed-end zippers 50, and removing the insertion pins 38 from their respective retaining boxes 36, such that all of the zipper tapes 10, 20, 11, 21 are fully disengaged. The cover suspension lines 132, 134 can be removed from the cover by reversing the procedure for passing through the passages described above, and the cover 200 stowed, optionally in a cover stuff sack.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A hammock assembly, comprising:

a hammock having:

a hammock body and configured to be suspended along a longitudinal axis between first and second supports; and a suspension system providing a suspension triangle at each of the first and second ends of the hammock body, the suspension triangle at the first end of the hammock body comprising a first pair of suspension devices each mechanically secured to the ends of a first spreader bar, and connected at the other end of the first pair of suspension devices to a first anchor point; the suspension triangle at the second end of the hammock body comprising a second pair of suspension devices each mechanically secured to the ends of a second spreader bar, and connected at the other end of the second pair of suspension devices to a second anchor point;

a cover having a cover body and configured to be suspended above and removably attachable to the hammock;

a zipper fastening system configured to reversibly secure the cover to the hammock body; and a cover suspension system having a first cover suspension line configured to suspend a portion of the cover and a second cover suspension line configured to suspend a portion of the cover in a generally planar horizontal configuration between the first and second cover suspension lines, the first cover suspension line and the second cover suspension line supports the cover along a length of the cover to create an enclosable space between the hammock and the cover; and the first and second spreader bars each having ends configured to be mechanically secured to the first end and second end of the hammock body, respectively, and configured to maintain the hammock body in an expanded state in an orientation that is perpendicular to the longitudinal axis;

wherein the first cover suspension line is extended between one of the suspension devices in the suspension triangle at the first end of the hammock to one of the suspension devices in the suspension triangle at the second end of the hammock, and the second cover suspension line is extended between the other of the suspension devices in the suspension triangle at the first end of the hammock to the other of the suspension devices in the suspension triangle at the second end of the hammock, and the first and second cover suspension lines are extended without crossing;

wherein the first and second cover suspension lines each pass through the cover body at a respective first passage located at a first end of the cover body, and through the cover body at a respective second passage located at a second end of the cover body.

2. The hammock assembly of claim 1, wherein the zipper fastening system has a first tape section attached to an edge of the hammock body and a second tape section attached to an edge of the cover body and corresponding to the first tape section, such that the cover is removably attached to the hammock by connecting the first tape section and the second tape section.

3. The hammock assembly of claim 2, wherein the first tape section has a first set of fastener elements extending along a length thereof, a first retainer box positioned at a first end of the first set of fastener elements, and a first slider movably attached to the first tape section and engageable with the first retainer box.

4. The hammock assembly of claim 2, wherein the hammock body further comprises at least one gusset at a corner of the hammock body, the at least one gusset serving to facilitate the actuation of the zipper fastening system at the comer.

5. The hammock assembly of claim 4, wherein the at least one gusset is a flexible material extending in from a perimeter of the hammock body at a corner, and to which the first tape section is attached.

6. The hammock assembly of claim 1, wherein each of the first and second passages provide a grommet through which the respective first or second cover suspension lines pass.

7. The hammock assembly of claim 6, wherein each of the first and second passages have a reinforcement securing the grommet to the cover body.

8. The hammock assembly of claim 7, wherein each of the first and second passages further comprise a repositionable seal that seals the opening of the passage after the respective first or second cover suspension line has passed through.

9. The hammock assembly of claim 1, wherein the cover body is formed of a first material and a second material.

10. The hammock assembly of claim 9, wherein the first material is formed of nylon, cotton, silk, polyester, polypropylene, polyethylene, or polytetrafluoroethylene, and the second material is a netting material.

11. The hammock assembly of claim 10, wherein the second material constitutes a sufficient percentage of the cover body to permit adequate ventilation from an enclosed space between the hammock and the cover.

12. The hammock assembly of claim 1, wherein the cover body is formed of a netting material.

13. The hammock assembly of claim 1, wherein the cover further comprises a location identifier, and the hammock body further comprises a corresponding location identifier, such that the cover location identifier and hammock body location identifiers when aligned, ensure that the cover is in proper orientation to be suspended over the hammock body.

14. The hammock assembly of claim 1, wherein the generally planar horizontal configuration of the suspended cover portion between the first and second cover suspension lines has a width dimension perpendicular to the longitudinal axis, and the width dimension is at least half the width dimension of the hammock body perpendicular to the longitudinal axis.

15. The hammock assembly of claim 1, wherein a portion of the cover is not suspended in a generally planar horizontal orientation, and is extended between the first or second cover suspension lines and a long edge of the hammock body at an angle that exceeds 50 degrees from horizontal.

* * * * *